United States Patent [19]

Olenwine

[11] Patent Number: 4,614,212

[45] Date of Patent: Sep. 30, 1986

[54] SHEDDING MECHANISM FOR WEAVING LOOMS

[75] Inventor: Ronald G. Olenwine, Greensboro, N.C.

[73] Assignee: Draper Corporation, Greensboro, N.C.

[21] Appl. No.: 616,619

[22] Filed: Jun. 4, 1984

[51] Int. Cl.[4] ..... D03C 5/00

[52] U.S. Cl. ..... 139/79

[58] Field of Search ..... 139/79, 80, 81, 57, 139/58, 190; 74/569

[56] References Cited

U.S. PATENT DOCUMENTS

| | | | |
|---|---|---|---|
| 100,575 | 3/1870 | Wickers et al. | 139/79 |
| 3,349,808 | 10/1967 | Gustafson et al. | 139/79 |
| 3,866,634 | 2/1975 | Rutkevich et al. | 139/79 |

FOREIGN PATENT DOCUMENTS

| | | | |
|---|---|---|---|
| 450687 | of 1949 | Italy | 139/79 |

*Primary Examiner*—Henry S. Jaudon

*Attorney, Agent, or Firm*—Charles R. Rhodes; Judith E. Garmon

[57] ABSTRACT

A positive harness drive mechanism raises and lowers the harnesses of a weaving loom responsive to a control cam that engages the followers of a pair of actuators at all times, regardless of the stroke direction, resulting in a smoother, more controlled stroke than is available in previous devices. The cam utilized herein is a double-landed or split cam mounted on the cam shaft by a pair of clamping collars. The actuators are adjustably connected to a pair of corresponding treadles that in turn lift and lower corresponding harnesses.

4 Claims, 7 Drawing Figures

SHEDDING MECHANISM FOR WEAVING LOOMS

BACKGROUND AND SUMMARY OF THE PRESENT INVENTION

Shedding is the well known operation during weaving when the warp yarn harnesses are raised and lowered to create an opening in the shape of a "V", called the shed, between layers of warp yarn. This occurs as some harnesses are raised while alternate harnesses are lowered. The shuttle passes through the "V"-shaped opening and inserts a pick of filling. The harnesses then reverse, capturing the previous pick and forming a new opening for a subsequent pick.

While shedding motions may vary widely from one type of loom to another, they generally fall into one of two categories. Either the harnesses are biased upwardly by a spring and pulled downwardly by some type of lever mechanism, or else the harnesses are biased downwardly and pulled upwardly by a dobby mechanism. Therefore, most of the shedding mechanisms in the prior art rely on springs or a combination of springs and gravity to urge the harnesses in one direction. Such devices may be satisfactory when used in connection with fly shuttle or rapier (shuttleless) looms which operate at speeds up to 300–400 picks per minute. However, with the advent of air jet looms and speeds in the range of 600 picks per minute, problems are envisioned by the previous known shedding mechanisms which rely heavily on springs.

It should be pointed out here that there are some examples in the prior art of shedding mechanisms which do not rely on springs and/or gravity to drive the harnesses, but are to the contrary positively driven in both stroke directions. These examples include the drive mechanisms disclosed in U.S. Pat. Nos. 4,337,801 issued July 6, 1982; 2,408,645 issued Oct. 1, 1946; and 3,168,116 issued Feb. 2, 1965. In each of the aforementioned approaches, the shedding mechanism positively drives the harnesses during the upward stroke as well as during the downward stroke. However, each of them involve a rather complicated system of linkages which would make a smooth stroke at high speeds very difficult, if not impossible. In addition, each approach set forth in the above-identified patents utilizes a crank mounted at the stub end of some auxiliary shaft as the operative member which synchronously connects the movement of the loom mechanism to the the harnesses. In many types of looms, e.g. Draper looms, there is an existing cam shaft and the attachment is made beneath the central portion of the loom. In such situations it is not possible to connect a crank to the cam shaft, because the cam shaft continues across the entirety of the width of the loom. Therefore a cam of the type where followers engage one or more peripheral drive surfaces must be used. "Positive drive," which occurs where the drive surface always engages one or more followers, in such devices is not known to applicant. In a further U.S. patent, U.S. Pat. No. 3,108,617 to Nichols, there is shown a selvage harness control which is operated by a facing cam, which in turn is operated from a pinion on the main cam shaft; however, this is a totally different environment.

In the present invention, on the other hand, the ultimate object is to provide a shedding mechanism that will effect a smooth, consistant, positive harness motion even at speeds in the range of 600 picks per minute.

Toward this end, there are several criteria which must be addressed in order to achieve the overall goal of smooth continuous harness motion. These criteria include a positive drive motion, simplicity, and assurance of synchronization of harness motion. In an effort to make the operation of the harnesses as smooth as possible, it was decided that the mechanism should be as simple as possible and the number of operative links in the mechanism kept to a minimum. Thus, the shedding mechanism of the present invention is operated directly from a control cam on the main cam shaft or an auxiliary cam shaft. This control cam is double-landed (two drive surfaces) so that the synchronization of the upper harness and lower harness strokes may be facilitated. A pair of yokes or actuator means connect the double-landed cam to a pair of L-shaped treadles, one of which operates one set of harnesses and the other of which operates the other set of harnesses. Each yoke includes a bifurcated portion at one end which substantially surrounds the eccentric drive surface of the cam and includes followers attached thereto. Such a construction is critical to the smooth operation of the shedding mechanism so that no matter whether the harnesses are undergoing an upward stroke or a downward stroke, the drive surface of the cam is always engaged positively with one or more of the followers in the yoke. Thus there is no possibility that the followers will leave the surface of the cam, and a much smoother, reliable stroke is obtained.

The opposite end of each yoke is attached to one leg of one of the L-shaped treadles. The other leg of the treadle is connected to one of the harnesses by means of a connecting rod. Thus, as the cam rotates, it causes the opposite end of the yoke to reciprocate, which in turn, causes the treadles to pivot about the axis of a rocker shaft. In a preferred embodiment the set of treadles connected to the yokes are, in turn, connected to another set of treadles, horizontally spaced from the first set. Each set of treadles is connected to one end of a set of harnesses. The resulting motion of the two sets of treadles raises and lowers the harnesses synchronously in a very regular, smooth, continuous motion. A slot is provided in the leg of the treadle to which the yoke is attached, so that the opening between the upper and lower warp yarns of the shed may be varied. The double-landed cam is fabricated in two halves, each half being assembled on opposite sides of the cam shaft, and the halves bolted together. A pair of tightening collars then are applied to the cams to tighten them securely to the cam shaft without the use of set screws thereby facilitating axial and rotational positioning of the cam on the shaft relative to other loom system functions.

It is therefore a principal object of the present invention to provide a shedding mechanism for weaving looms, which shedding mechanism provides a smooth, regular harness stroke even at high speeds.

Another object of the present invention is to obtain the smooth, regular harness stroke as described hereinabove with a very simple mechanism which is driven from the cam shaft or an auxiliary cam shaft of the loom.

Yet another object of the present invention is to provide a shedding mechanism of the type described in which each actuator contains a plurality of followers, one or more of which are in continuous engagement with the drive surface of the drive cam as it rotates.

Still another object of the present invention is to provide a shedding mechanism of the type described in which the harnesses are positively driven both in their upward stroke and in their downward stroke.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
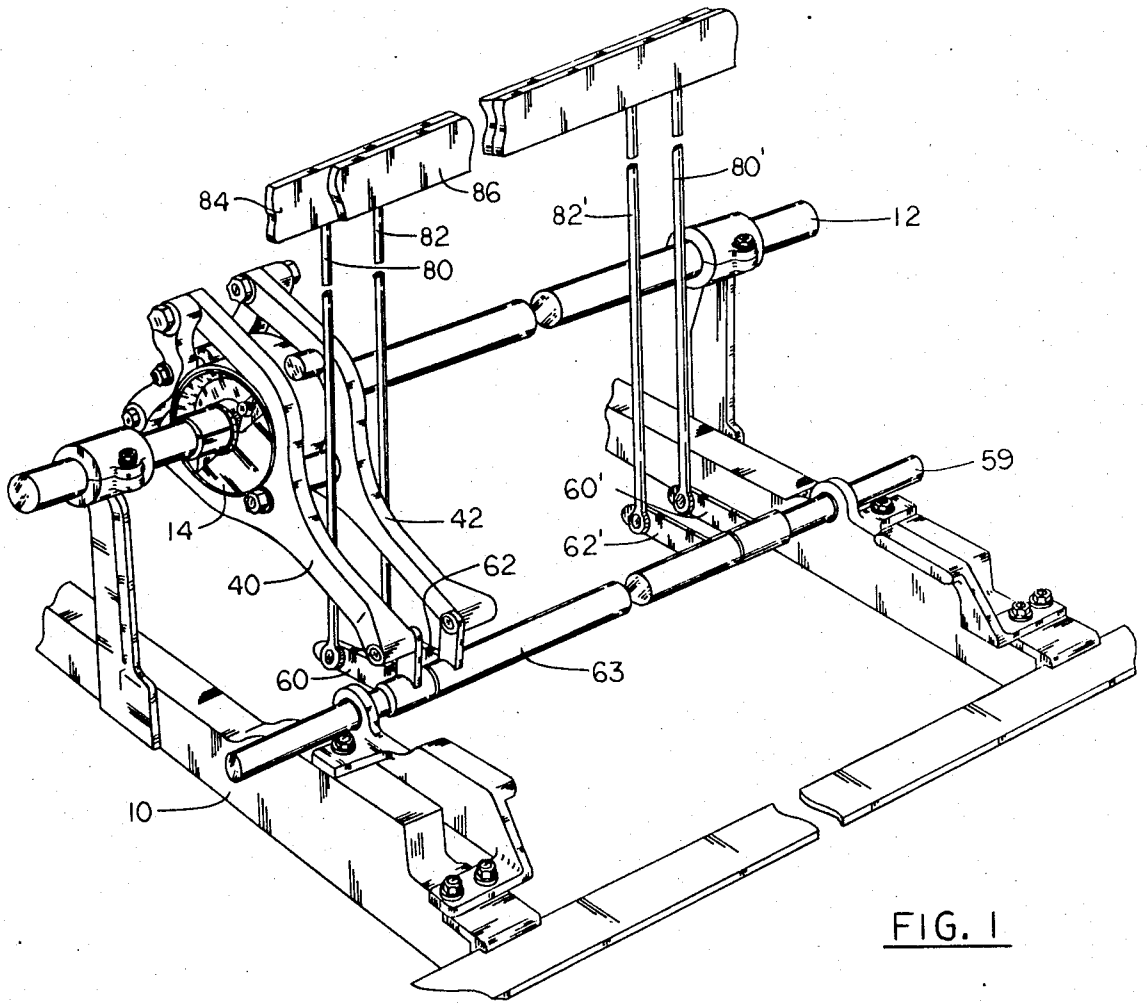
FIG. 1 is a perspective view of the shedding mechanism according to a preferred embodiment of the present invention.

Turning now to the drawings, there is illustrated in FIG. 1 the portion of a loom including the usual frame members 10 on which is mounted a cam shaft 12. The cam shaft 12 is connected at one end to a gear (not shown) which enables the cam shaft to be rotated synchronously with the other machine elements. The cam shaft 12 carries various types of cams including pick cams, selvage cams, warp stop motion cams and filling cams (not shown). The harness control cam 14 is also carried by cam shaft 12 and initiates the harness shedding mechanism of the present invention. While the control cam 14 is illustrated and described herein as being mounted on the cam shaft 12, it could obviously be mounted on an auxiliary shaft that is caused to rotate synchronously with the other machine elements as is present in other conventional looms.

Harness control cam 14 will be described more fully hereinafter; however, at this point for purposes of discussion it suffices to note that control cam 14 includes means for securing the cam to the aforementioned rotating cam shaft 12 for rotation therewith and includes a pair of drive surfaces 20,22, one of which serves to activate one of the harnesses, and the other surface which is 180° displaced therefrom and serves to actuate the other harness or set of harnesses. An actuator means 40,42 is mounted at one end on each cam surface and connects the corresponding control cam drive surface to a treadle means 60,62.

As cam 14 rotates, each actuator means 40,42 is caused to reciprocate, thereby effecting a stroke motion. This stroke motion is transferred to the treadles 60,62 and 60',62' causing the lower arms thereof to lift and lower in timed relation to each other. The treadles 60,62 are connected to the warp harnesses 84,86 by connecting members 80,82 and 80',82' respectively.

So arranged with one set of warp yarns extending through one of the harnesses 84,86 and the other set of warp yarns extending through the opposite one of harnesses 84,86, as the control cam 14 rotates the stroke of actuators 40,42 causes one of the harnesses 84,86 to lift while the other lowers, and then the other lifts while the one is lowered, creating the shedding motion. Thus, the unique positive harness motion of the present invention causes each treadle to move between a first position in which the associated harness 84,86 is down and a second position in which the associated harness 84,86 is up. The treadles 60,62 and 60',62' are caused to be activated in this manner as a result of the associated actuator means 40,42 being reciprocated back and forth against an upstanding arm on each treadle as will be described hereinafter. As has been explained hereinabove, the motion of the actuator arm and thus the lifting and lowering of the harnesses 84,86 as a result of the present invention are caused to move in a smooth continuous motion thereby facilitating higher loom speeds. This is possible because of the positive engagement at all times between the cam means 14 and the actuating means 40,42 in a manner not heretofore known.

Figure 2:
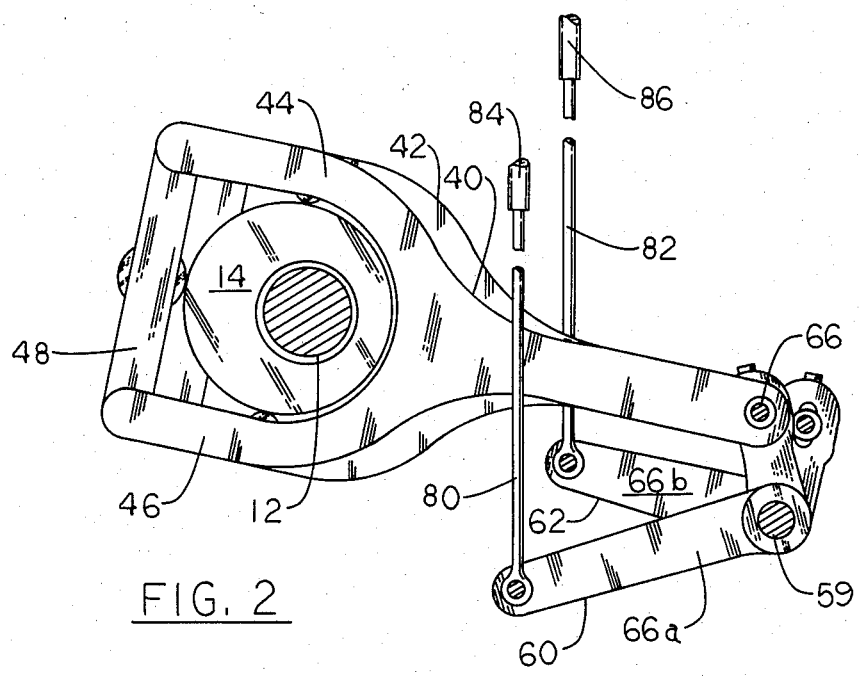
FIG. 2 is a side schematic view of the shedding mechanism of FIG. 1 illustrating the harnesses in one position.
Figure 3:
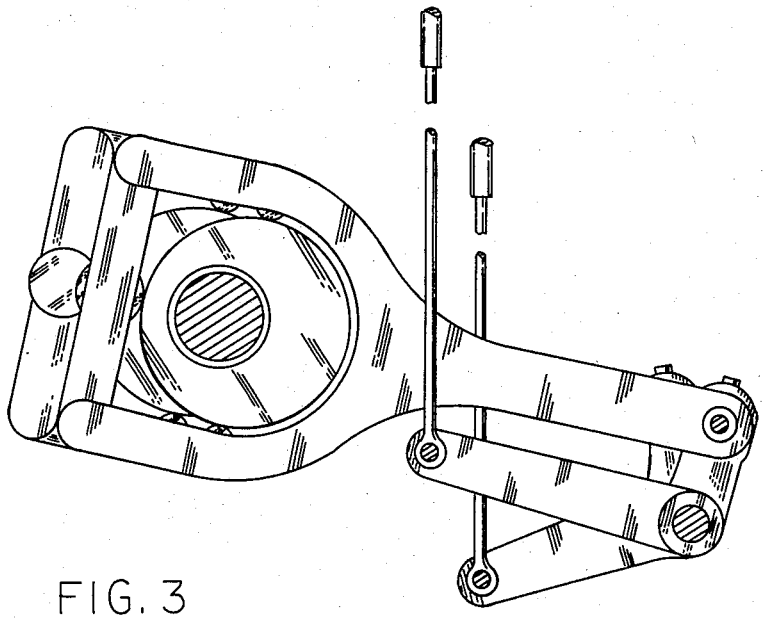
FIG. 3 is a side schematic view illustrating the harnesses in the opposite position.

Turning now to a discussion of how this smooth continuous motion is effected, attention is directed to FIGS. 2 and 3. First of all it should be noted that treadles 60 and 62 are, in general, L-shaped levers with each having a generally vertical arm 64 and a generally horizontal arm 66. It should also be pointed out here that the generally horizontal arm **66*a* of treadle 60 is slightly longer than the horizontal arm 66*b* of treadle 62. This is because each of treadles 60,62 operatively control separate front/back spaced harnesses. Also, both treadles 60 and 60' are keyed to support shaft 59, so that as treadle 60 is activated by actuator (yoke) 40, the force is transferred to treadle 60'. Thus treadle 60' moves synchronously with treadle 60. Further, treadle 62 is connected to treadle 62' by a hollow shaft 63, which is rotatably mounted on shaft 59. In this way the force on treadle 62 is transferred synchronously to treadle 62'. Each actuator 40,42 is pivotally attached to a slotted opening 68 in the upstanding arm 64 by conventional bolt, nut, and washer assemblies. Connector members 80,82 are pivotally attached to the free end of the generally horizontally extending arms 66*a*,66*b* and operatively support warp yarn harnesses 84,86**.

As illustrated in FIGS. 2 and 3, the actuator arm includes a bifurcated portion at the end thereof opposite the end to which the arm is attached to one of treadles 60,62. The bifurcated portion generally surrounds the cam 14 in close proximity to one of the drive surfaces thereof. It is to be recognized that actuator means 40 engages and is activated by one of the cam drive surfaces and actuator 42 is engaged by and actuated by the other cam drive surface. Positioned within the bifurcated portion of each actuator 40,42 are a plurality of followers in the form of rollers or bearings, as will be described more fully hereinafter. It should also be noted that where the actuator means 40,42 split into two portions 46,48 a tie bar 52 connects the free ends thereof. The tie bar also includes bearings or rollers which engage one arcuate portion of each cam surface. The distance between the followers 50 located in the actuator means 40,42 is approximately the same as the diameter of the adjacent drive surface of cam 14. Thus, the cam and actuator are always in positive engagement no matter which direction the actuator arm is moving during the stroke. This is critical to the present invention and a distinct difference between the present invention and known harness motion devices.

In FIG. 2, the arrangement shows that the cam 14 is in such a position that actuator 40 is retracted and actuator 42 is extended. Through the treadles 60,62, this then means that harness 84 is down and harness 86 is up, forming the warp shed at this instant. In FIG. 3, the cam 14 has rotated 180° so that the actuator 40 is extended and the actuator 42 retracted. The result is that the harnesses have reversed with harness 84 now being raised and harness 86 now being lowered.

Figure 6:
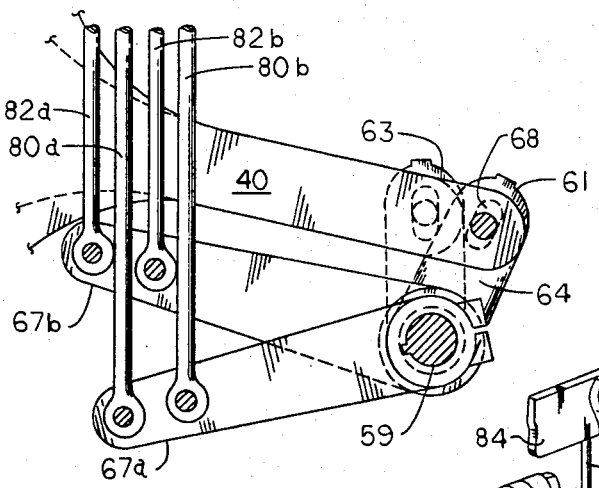
FIG. 6 is a side schematic view illustrating the concept of the present invention as applied to multiple harness arrangements.

In an alternate embodiment illustrated in FIG. 6, the mechanism according to the present invention may be utilized to control more than a single pair of warp yarn harnesses. In the embodiment of FIG. 6, each horizontal arm 67*a* and 67*b* of treadles 61 and 63 has attached thereto a plurality of connecting members 80*a*,80*b* and 82*a*,82*b*. Thus, each of treadles 61 and 63 will control a plurality of warp harnesses in the same manner as described hereinabove. Otherwise there is no difference in the drive mechanism.

Figure 4:
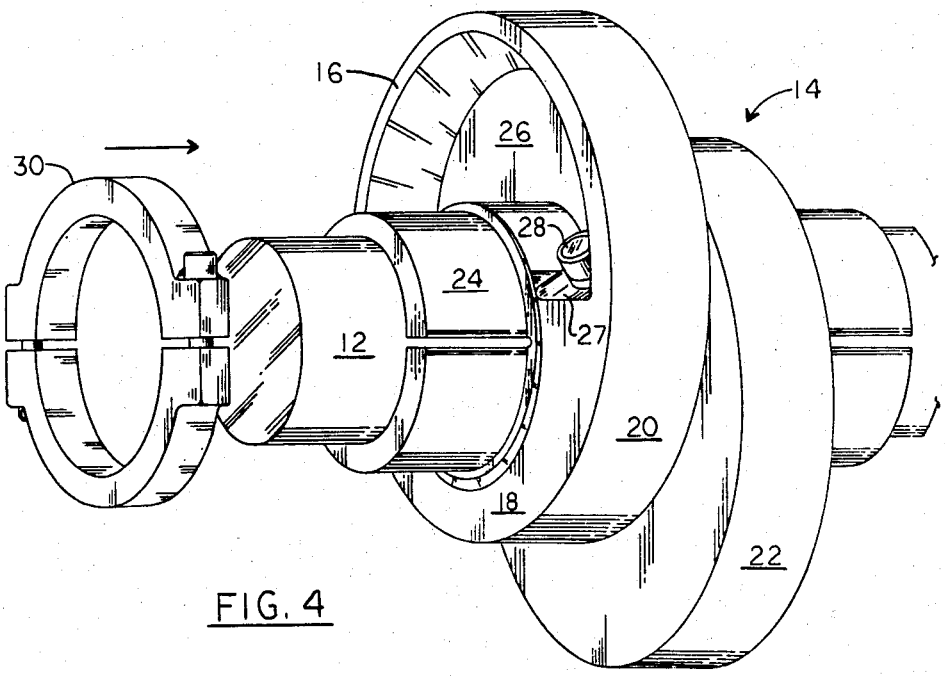
FIG. 4 is a perspective view of the cam assembly as contemplated for use with the present invention.

Turning now to FIG. 4, there is illustrated the cam means 14 which is utilized to operate actuator 40,42 in their desired stroke motion. Although the actuators 40,42 are separate, and although separate cams could be used on cam shaft 12, it is preferred that the cam means 14 be constructed as a unit, thereby eliminating any need for positioning and adjusting two cams with relation to each other to provide a synchronous harness motion as is often the case.

The cam means 14 of FIG. 4 is initially cast in two halves 16 and 18 with the dividing line extending axially through the cam, although the break line is not diametrically across either of the cams 20 or 22. Each cam half 16,18 is cast from suitable material, then the cam surfaces 20,22 are machined to form a smooth even surface for the bearings to ride upon. It should be noted in FIG. 4 that neither of the cam surfaces 20,22 are concentric with respect to the cam shaft. For that matter, each is 180° displaced from the other so that as actuator 40 is driven forward, actuator 42 is driven rearwardly, and the forwardmost extent of actuator 40 occurs at the same instant as the rearmost extent of the stroke of actuator 42. A shoulder 24 extends axially from each opposite face of the cam means 14.

Further, each face includes a hollowed out portion 26 and an inclined portion 27 through which holes are drilled and tapped. A pair of threaded fastener members 28 then secure the two halves 16,18 of cam means 14 together after they have been assembled around cam shaft 12. A collar 30 then extends around shoulder 24, and secures the cam halves 16,18 to cam shaft 12.

As previously described, the two-piece cam facilitates retrofitting and adjustment on elongated cam shafts. However, it should be noted that in situations where a "stub" cam shaft is provided with the loom a one-piece cam will suffice, because it can be easily assembled and disassembled. Thus the invention here presented should not be considered as being limited to two-piece cams.

Figure 5:
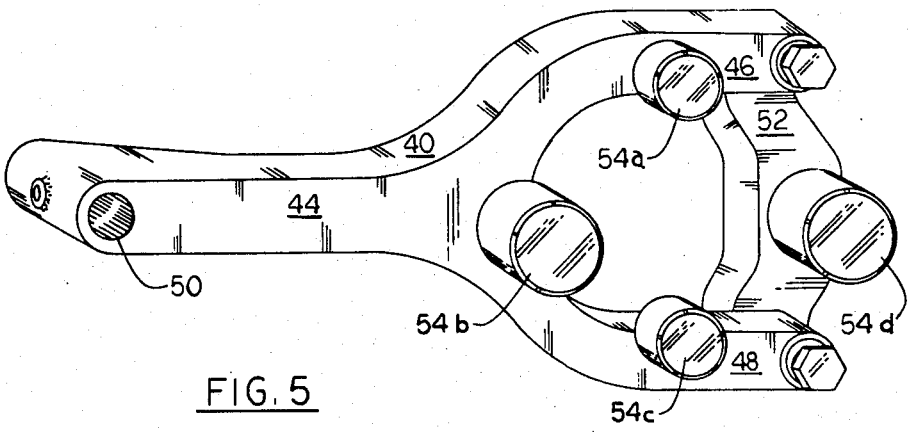
FIG. 5 is a perspective view of the unique yoke assembly according to the present invention.

Actuator 40 is illustrated in FIG. 5 and it should be here pointed out that actuator means 42 is identical, therefore, only one will be discussed. Actuator 40 includes a main portion 44 and a bifurcated portion providing upper segment 46 and lower segment 48, which surround cam means 14 when assembled. The main portion 44 of actuator 40 includes an opening 50 at the opposite end thereof by which the actuator 40 is pivotally attached to the upstanding arm 64 of treadle member 60. A tie bar 52 extends between the extremities of upper segment 46 and lower segment 48. Followers 54*a*,54*b*, and 54*c* are rotatably attached to the bifurcated portion of actuator arm 40 and follower 54*d* is attached to the tie bar 52. The followers 54*a*–54*d* are illustrated as rollers; however, they could also be ball-type bearings if suitably housed. The important thing about followers 54*a*–54*d* is that the distance between opposite ones thereof, i.e. between follower 54*a* and follower 54*c* or between follower 54*b* and 54*d*, is substantially the same as the diametric dimension of the two drive surfaces 20,22 of cam means 14.

Thus, the use of the unique cam means and the positive drive motion of the harnesses through the actuator arms provide an improved shedding motion over those provided by mechanisms of the prior art. The fact that the cam landing surfaces 20,22 of the cam means 14 are always in engagement with one or more of the followers 54*a*–54*d* provides this positive driving motion. There are no times when springs or gravity are moving the harnesses from one position to another, and there are no times when it is possible for all cam followers to simultaneously be removed from the surface of the cam. As a result of this combination of effects, the drive motion achieved by the shedding mechanism of the present invention achieves a smooth stroke which enables higher speeds to be realized.

Figure 7:
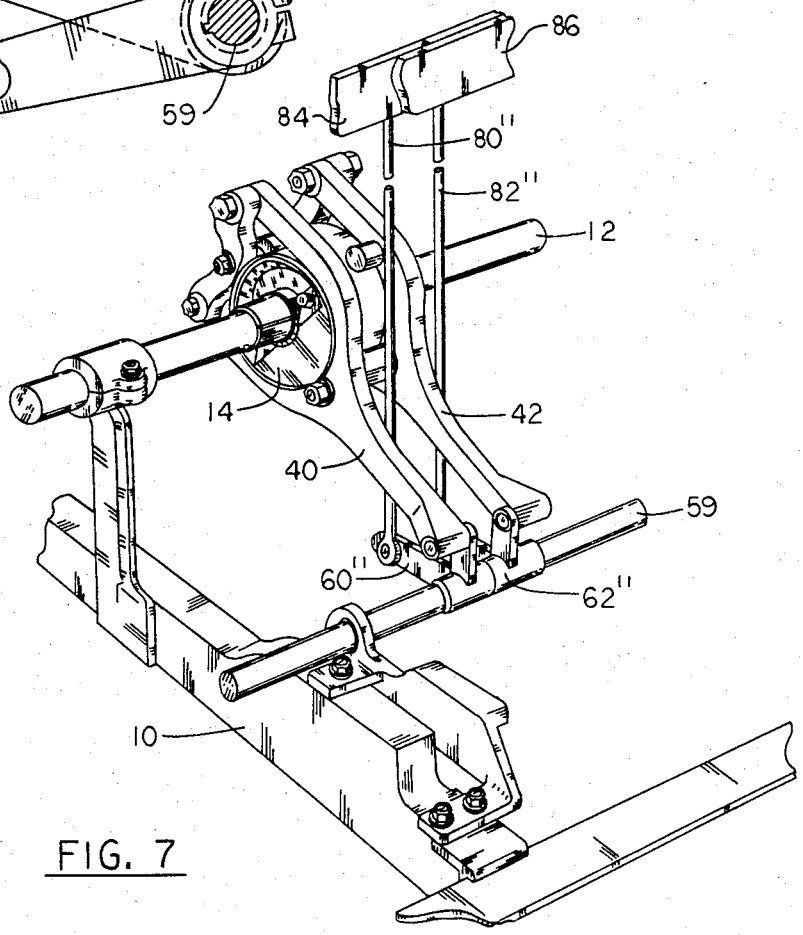
FIG. 7 is a perspective view of the shedding mechanism according to an alternate embodiment of the present invention.

In FIG. 7, there is illustrated an alternate embodiment of the shedding mechanism for use on looms having a slightly wider warp beam. In such cases a separate, but synchronized, set of treadles 60″,62″ and connecting rods 80″,82″ are provided on each side of the loom, each connected to opposite ends of harnesses 84,86. This eliminates any need for transferring the rotational force from one set of treadles to another set as is the case in the preferred embodiment.

It should be recognized that while a preferred embodiment of the present invention has been shown and described in detail herein, various changes and modifications might be made to the invention without departing from the scope thereof which is set forth in the accompanying claims.

I claim:

1. A positive harness motion mechanism for shedding the harnesses of a weaving loom comprising:

(a) a treadle means connected to each of said harnesses by a connecting member, said treadle means being movable between a first position in which the associated harness is down and a second position in which said associated harness is up;

(b) a shaft rotating in synchronization with the weaving operation of the loom;

(c) cam means and means for securing said cam means to said rotating shaft for rotation therewith;

(d) an actuator means including a main portion having one end thereof pivotally attached to said treadle means; and (e) said other end of said main portion being attached to a bifurcated portion in the form of upper and lower segments surrounding said cam means and a tie rod joining the free ends of said upper and lower segment, rollers attached to said main portion, said upper and lower segments and said tie rod adjacent said cam means; the distance between opposite ones of said rollers being substantially the same as the diameter of the corresponding drive surface of said cam means so that said rollers operatively engage with said cam means for positively moving said treadle between said first and second positions in a smooth continuous motion responsive to the rotation of said cam shaft.

2. The harness motion mechanism according to claim 1 wherein said cam means comprises two cam halves selectively joined together around said rotating shaft, said cam means including two drive surfaces thereon, each drive surface being 180° displaced from the other, and each of said drive surfaces operatively connected to one of said treadle means through said actuator means, collar means for securing said cam means to said cam shaft.

3. The harness motion mechanism according to claim 1 wherein said treadle means includes a generally L-shaped treadle member having an upstanding arm and a generally horizontally extending arm; said treadle means being attached to a support shaft for pivotal movement about the axis thereof; said upstanding arm being pivotally connected to said actuator means and the free end of said generally horizontally extending arm being operatively connected to one harness through a connecting member whereby the reciprocating stroke of said actuator means is transmitted into a vertically reciprocating stroke of said harness.

4. The harness motion mechanism according to claim 3 wherein the upstanding arm includes a slot therein for securing the end of said actuator means at one of a selected plurality of positions, so that the opening of said shed may be selectively varied.

* * * * *